United States Patent [19]

Pfeffer et al.

[11] Patent Number: 4,784,093

[45] Date of Patent: Nov. 15, 1988

[54] ARRANGEMENT FOR CONTROLLING THE OIL FEED TO A CONTROL CHAMBER OF A PISTON WITH VARIABLE COMPRESSION HEIGHT

[75] Inventors: Viktor Pfeffer; Friedrich Wirbeleit, both of Stuttgart, Fed. Rep. of Germany

[73] Assignee: Daimler-Benz Aktiengesellschaft, Stuttgart, Fed. Rep. of Germany

[21] Appl. No.: 118,047

[22] Filed: Nov. 9, 1987

[30] Foreign Application Priority Data

Nov. 13, 1986 [DE] Fed. Rep. of Germany ..... 3638783

[51] Int. Cl.[4] ..... F02B 75/04

[52] U.S. Cl. ..... 123/78 B; 123/196 R; 123/48 B

[58] Field of Search ..... 123/78 B, 48 B, 196 R

[56] References Cited

U.S. PATENT DOCUMENTS

| | | | |
|---|---|---|---|
| 3,656,582 | 4/1972 | Alcock | 123/196 R |
| 4,195,601 | 4/1980 | Crise | 123/78 E |
| 4,515,110 | 5/1985 | Perry | 123/196 R |

FOREIGN PATENT DOCUMENTS

| | | |
|---|---|---|
| 2753563 | 6/1979 | Fed. Rep. of Germany . |
| 3416346 | 11/1985 | Fed. Rep. of Germany . |

OTHER PUBLICATIONS

"Development of Pistons with Variable Compression Height for Increasing Efficiency and Power of Combustion Engines", MTZ Motortechnische Zeitschrift 47 (1986) 5-pp. 191-196.

*Primary Examiner*—E. Rollins Cross

*Attorney, Agent, or Firm*—Barnes & Thornburg

[57] ABSTRACT

The invention relates to a piston with variable compression height, particularly for internal-combustion engines, that consists of an interior piston part to which a connecting rod is coupled, and an exterior piston part that is slidably held at said interior piston part. In this case, the exterior piston, via two control chambers that are supplied with oil from the lubricating oil circuit, supports itself by adherence at the interior piston part, said control chambers being connected by a hydraulic system. In order to, in the process, keep the pressure in the oil feed to one control chamber approximately constant over the whole rotational speed range of the internal-combustion engine, the control chamber is connected to the lubricating oil circuit by means of a non-rotating control oil groove in the connecting rod bearing only in an indicated crank angle range, and/or the oil-carrying grooves and bores in the piston and in the connecting rod are coordinated with one another with respect to their cross-sections.

13 Claims, 2 Drawing Sheets

ARRANGEMENT FOR CONTROLLING THE OIL FEED TO A CONTROL CHAMBER OF A PISTON WITH VARIABLE COMPRESSION HEIGHT

BACKGROUND OF THE INVENTION

The invention relates to an arrangement for controlling the oil feed to a control chamber of a piston with variable compression height particularly for internal-combustion engines, which control chamber is arranged between an interior piston part and an exterior piston part that is slidably guided at it, and which control chamber is connected to the lubricating oil circuit of the internal-combustion engine, via an oil bore arranged in said interior piston part, into the course of which a check valve is inserted that opens in the direction of said control chamber, and which oil bore leads out into an oil groove in a connecting rod small end bush of the connecting rod shaft to a control oil groove in the connecting rod bearing, and via a transverse bore extending in the crank pin between the control oil groove and a main oil bore.

On the basis of German Published Unexamined Application (DE-OS) No. 34 16 346, it is known, in the case of a piston of the above-described type, to control the oil feed to the control chamber by means of a pressure-regulating valve that is integrated specifically into the hollow piston pin. The pressure-regulating valve is therefore constructed in such a way that, starting from a certain adjustable pressure difference between the control sides of the control slide, lubricating oil is directed from the longitudinal bore of the piston shaft into the oil bore in the interior piston part. As a result, mainly the pressure in the oil in front of the check valve can be kept constant irrespective of the pressure of the oil in the lubricating system.

One disadvantage with this above-noted arrangement is the manufacturing and mounting expenditures that are connected with the use of the pressure-regulating valve, and another disadvantage is the enlargement of the oscillating mass at the piston pin that results from that construction.

An object of the invention is to improve the known arrangement in such a way that, irrespective of a pressure-regulating valve within the oil bore and upstream of the check valve, an approximately constant oil pressure can be maintained in the incoming lubricating oil.

According to the invention, this objective is achieved in one preferred embodiment by providing that the control groove at the crank lifting journal bearing extends only over a portion of the circumference of the bearing so as to provide for connection with the lubricating oil circuit only over a predetermined portion of the piston stroke cycle. This objective is achieved in another preferred embodiment of the invention by appropriate cross-sectional area matching of the oil carrying grooves and bores.

By means of the invention, it is achieved that also, without the use of a pressure-regulating valve, the oil that is branched off from the lubricating-oil circuit for changing the compression height in the oil bore upstream of the check valve can be adjusted to a constant pressure. As a result of the elimination of the pressure-regulating valve, not only the oscillating mass of the piston is reduced, but the otherwise necessary manufacturing and mounting expenditures of the pressure-regulating valve are also eliminated.

Other objects, advantages and novel features of the present invention will become apparent from the following detailed description of the invention when considered in conjunction with the accompanying drawings.

DETAILED DESCRIPTION OF THE DRAWINGS

Figure 1:
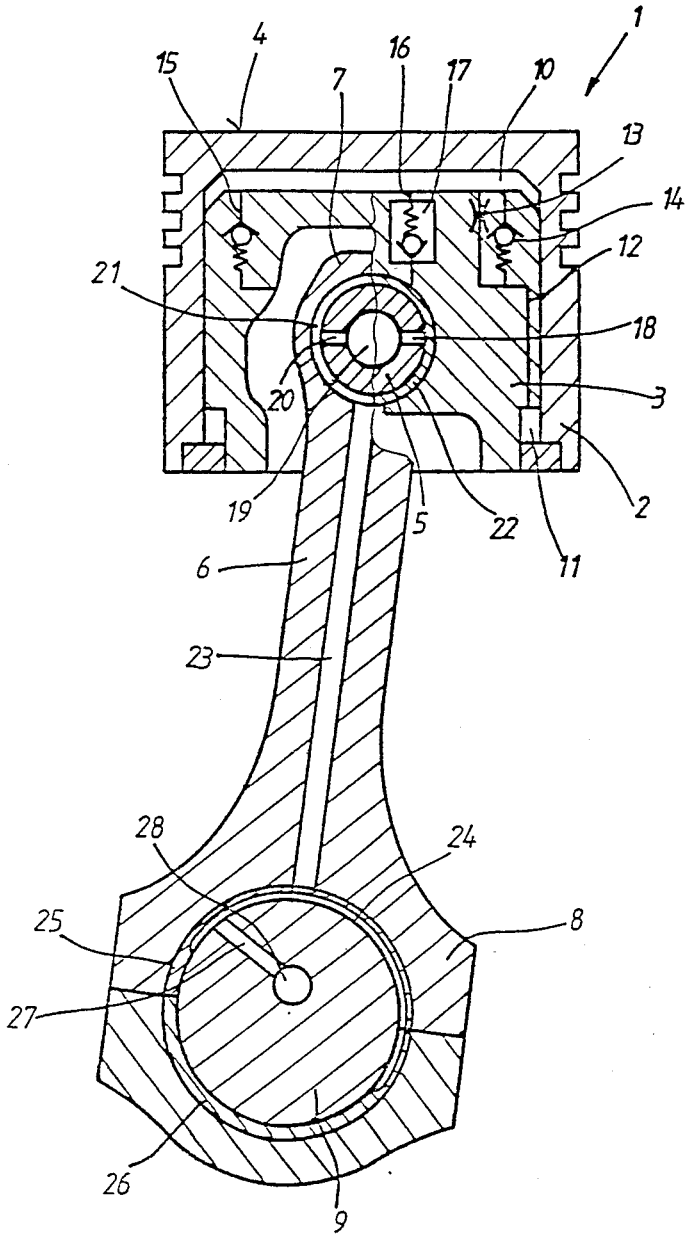
FIG. 1 is a schematic longitudinal sectional view of a piston/connection rod arrangement disposed shortly before the TDC-position and constructed according to a first preferred embodiment of the present invention.

A piston with a variable compression height that in the figures has the reference number 1 comprises an exterior piston part 2 and an interior piston part 3. The exterior piston part 2 contains the piston skirt and the piston head 4 and is held at the interior piston part 3 so that it can be slid in axial direction of the piston 1. In the interior piston part 3, according to the longitudinal sectional view shown in an offset way on the right of the longitudinal central axis, a piston pin 5 is inserted into two pistons bosses, a connecting rod 6 with its small connecting rod eye 7 being linked to this piston pin 5. The connecting rod 6, together with the piston 1, is disposed at a lifting journal 9 of a crankshaft that is not shown in detail via a connecting rod bearing 8.

Between the exterior piston part 2 and the interior piston part 3, an upper control chamber 10 is enclosed that is connected with a lower control chamber 11 by means of a connecting bore 12 in which a throttle 13 and, parallel to the throttle 13, a check valve 14 are arranged.

Both control chambers 10 and 11 are filled with oil from the lubricating-oil circuit. The change of compression height is caused by the force affecting the exterior piston part 2—resulting from gas forces, inertia forces and frictional forces—in which oil is displaced from one control chamber to another control chamber. When the compression height is reduced, oil is directed away from the upper control chamber 10, via the pressure limiting valve 15, into the crankcase. The volume that is expanding in the lower control chamber 11 is filled up via the throttle 13 and the check valve 14.

When the compression height is increased, oil is pressed from the lower control chamber 11, via the throttle 13, and mainly from the piston pin 5, via the check valve 17, into the upper control chamber 10.

For supplying oil to the upper control chamber 10, an inlet bore 16 is located in the interior piston part 3, this inlet bore 16 leading out into a groove that is not shown in the interior piston part 3. In the course of the inlet bore 16, a check valve 17 is inserted that blocks the flowing-out of the oil from the control chamber 10. The groove in the interior piston part 3 is connected, via a bore 18, with the interior space 19 of the piston pin 5 that was drilled hollow. In this case, the interior space 19 forms an oil storage space from which oil can be taken continuously in the upward control phase. The interior space 19 is connected, via another bore 20, to an oil groove 21 in the bearing bush 22 of the connecting rod eye 7. The oil groove 21, in turn, is connected with a longitudinal bore 23 in the connecting rod 6 which leads out into a control oil groove 24 in the connecting rod bearing 8. The control oil groove 24 may also be provided in both bearing shells 25 and 26 of the connecting rod bearing 8. By means of a transverse bore 27 in the lifting journal 9, the connection takes place to the main oil bore 28 of the lubricating oil circuit.

As shown in FIG. 1, the control oil groove 24 extends only over a part of the circumference of the connecting rod bearing. As a result, it is achieved that oil is transported to the storage space 19 in the piston pin 5 only when the transverse bore 27 overlaps with the control oil groove 24. It is prferable to assign the control oil groove 24 in the bearing shells 25 and 26 and the transverse bore 27 to one another in such a way that the transverse bore 27, starting from the last third of the upward motion of the piston, and extending to the last third of the downward motion of the piston, overlaps with the control oil groove 24. By means of this groove position, it is ensured that in the BDC range, the connection between the transverse bore 27 and the control oil groove 24 is interrupted, which avoids a flowing-back of oil from the connecting rod which would result in an intake of air into the storage space 19. Finally, by means of the targeted periodic control of the oil inflow to the control chamber 10, it is possible to keep the oil pressure constant in front of the check valve 17.

Figure 2:
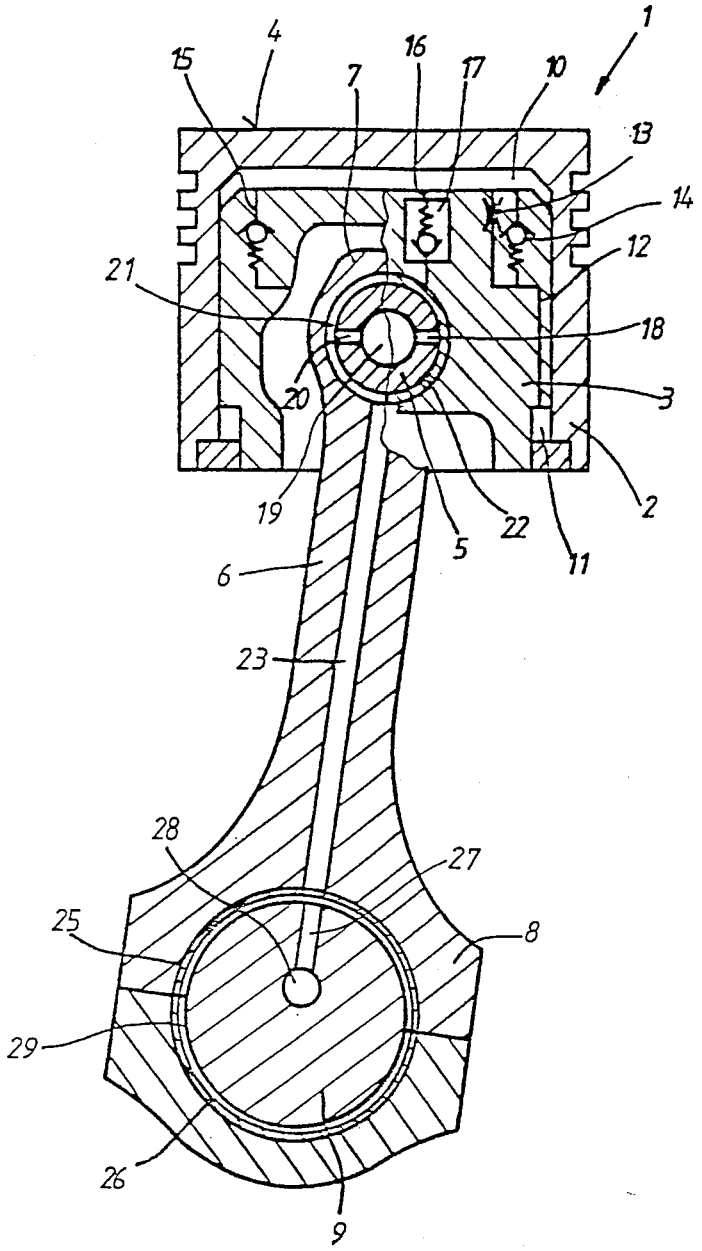
FIG. 2 is a view similar to FIG. 1 depicting a second preferred embodiment of the present invention.

According to the embodiment of FIG. 2, the oil inflow to the control chamber 10 of the piston 1 is controlled only by means of a cross-sectional matching of the oil-carrying grooves and bores.

For reasons of simplicity, the reference numbers used in FIG. 1 were used for the corresponding components in FIG. 2. The control oil groove 29 that is provided in the two bearing shells 25 and 26 of the connecting rod bearing 8 is developed as a surrounding groove so that oil is continuously available under pressure for the controlled feeding into the upper control chamber 10. The longitudinal bore 23 in the connecting rod shaft 6 is connected with the control oil groove 29 and leads out into the oil groove 21 in the connecting rod bush 22. In this case, the cross-sectional surface of the longitudinal bore 23 is developed to be four to ten times larger than the cross-sectional surface of the control oil groove 29. The oil groove 21 is connected to the inletbore 16 having the check valve 17 via the bore 20, the interior 19, the bore 18 and the groove in the interior piston part 3 that is not shown. The cross-section of the check valve 17 in this case is developed to be three to six times larger than the cross-sectional surface of the oil groove 21 and of the control oil groove 29 in the connecting rod bearing 8. In the case of this type of cross-sectional coordination of the oil-carrying grooves and bores, it is also possible to keep the pressure in the inlet bore 16 upstream of the check valve 17 approximately constant over the whole rotational speed range of the internal-combustion engine. Within the framework of the invention, it is conceivable that the control oil groove 29, corresponding to the embodiment of FIG. 1, extends only over a part of the bearing circumference in the connecting rod bearing 8.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An arrangement for the control of the oil feed to a control chamber of a piston with variable compression height, particularly for internal-combustion engines, which control chamber is arranged between an interior piston part and an exterior piston part that is slidably guided at it, and which control chamber is connected to the lubricating oil circuit of the internal-combustion engine, via an oil bore arranged in said interior piston part, into the course of which a check valve is inserted that opens in the direction of said control chamber, and which oil bore leads out into an oil groove in a connecting rod small end bush of the connecting rod coupled to said interior piston part, as well as via a longitudinal oil bore leading from the oil groove through the connecting rod shaft to a control oil groove in the connecting rod bearing, and via a transverse bore extending in the crank pin between the control oil groove and a main oil bore, wherein the control oil groove extends only over a part of the bearing circumference in the connecting rod bearing and in the range between the last third of the outward motion of the piston to the last third of the inward motion of the piston, overlaps with the transverse bore.

2. An arrangement for the control of the oil feed to a control chamber of a piston with variable compression height, particularly for internal-combustion engines, which control chamber is arranged between an interior piston part and an exterior piston part that is slidably guided at it, and which control chamber is connected to the lubricating oil circuit of the internal-combustion engine, via an oil bore arranged in said interior piston part, into the course of which a check valve is inserted that opens in the direction of said control chamber, and which oil bore leads out into an oil groove in a connecting rod small end bush of the connecting rod coupled to said interior piston part, as well as via a longitudinal oil bore leading from the oil groove through the connecting rod shaft to a control oil groove in the connecting rod bearing, and via a transverse bore extending in the crank pin between the control oil groove and a main oil bore, wherein the cross-sectional area of the check valve determining the passage within the oil bore 16 in each case is larger than that of the control oil groove in the connecting rod bearing and the oil groove in the connecting rod bushing, and the cross-sectional area of the longitudinal bore is larger than that of the control oil groove in the connecting rod bearing.

3. An arrangement according to claim 2, wherein, the cross-sectional areas of the check valve is three to six times larger than the cross-sectional areas of the oil groove in the connecting rod bushing.

4. An arrangement according to claim 2, wherein that the cross-sectional area of the longitudinal oil bore within the connecting rod shaft is four to ten times larger than the cross-sectional area of the control oil groove in the connecting rod bearing.

5. An arrangement according to claim 3, wherein that the cross-sectional area of the longitudinal oil bore within the connecting rod shaft is four to ten times larger than the cross-sectional area of the control oil groove in the connecting rod bearing.

6. An arrangement according to claim 2, wherein the cross-sectional area of the check valve is three to six times larger than the cross-sectional area of the control oil groove in the connecting rod bearing.

7. An arrangement according to claim 3, wherein the cross-sectional areas of the check valve 17 is three to six times larger than the cross-sectional surface of the control oil groove 29 in the connecting rod bearing.

8. An arrangement according to claim 4, wherein the cross-sectional area of the check valve is three to six times larger than the cross-sectional area of the control oil groove in the connecting rod bearing.

9. An arrangement according to claim 5, wherein the cross-sectional area of the check valve is three to six times larger than the cross-sectional area of the control oil groove in the connecting rod bearing.

10. A variable compression height piston construction comprising:

a connecting rod having one end attached to an engine lifting journal and the other end attached at a piston pin;

an interior piston part carried by the piston pin;

an external piston port slidably held at the interior piston part for movement between compression height adjusting positions;

a compression height adjusting control chamber disposed between the interior and exterior parts; and engine lubricating oil conduit means for controlling the supply of oil to the control chamber from a main oil bore extending in the engine lifting journal, said oil conduit means including a check valve opening in a direction to communicate oil from the main oil bore to the control chamber, wherein said oil conduit means are configured to control the supply of oil to the control chamber means to maintain an approximately constant pressure in front of the check valve without a pressure regulating valve.

11. A construction according to claim 10, wherein said oil conduit means includes a control oil groove extending along the bearing circumference of the lifting journal to an oil supply bore extending longitudinally of the connecting rod and a transverse bore leading from the main oil bore to the control oil groove, and wherein said control oil groove extends over only a part of the bearing circumference of the lifting journal such that the transverse bore communicates with the control oil groove only when the piston movement is in the range between the last third of its outward movement and the last third of its inward movement.

12. A construction according to claim 10, wherein said oil conduit means includes a control oil groove extending along the bearing circumference of the lifting journal to an oil supply bore extending longitudinally of the connecting rod and a transverse bore leading from the main oil bore to the control oil groove, and wherein said oil conduit means includes a second control oil groove extending along the bearing circumference of the piston pin upstream of the check valve, wherein the cross-sectional area of the check valve is larger than the cross-sectional area of the control oil groove an dthe second control oil groove, and wherein the cross-sectional area of an oil supply bore extending longitudinally of the connecting rod from the control oil groove has a cross-sectional area that is larger than that of the control oil groove.

13. A construction according to claim 12, wherein said control oil groove extends over the whole operational extent of the circumference of the lifting journal.

* * * * *